United States Patent [19]

Bauer et al.

[11] 4,425,657

[45] Jan. 10, 1984

[54] ELECTRODE FOR ARC FURNACES

[75] Inventors: Hanns G. Bauer, Witten-Bommern, Fed. Rep. of Germany; Dieter H. Zöllner, Claremorris, Ireland; Josef Otto; Josef Mühlenbeck, both of Wetter, Fed. Rep. of Germany; Friedrich Rittmann, Rückersdorf, Fed. Rep. of Germany; Claudio Conradty, Röthenbach a.d. Pegnitz, Fed. Rep. of Germany; Inge Lauterbach-Dammler, Nuremberg, Fed. Rep. of Germany; Horst Sonke, Leinburg, Fed. Rep. of Germany

[73] Assignee: C. Conradty Nurnberg GmbH & Co. KG, Fed. Rep. of Germany

[21] Appl. No.: 285,563

[22] Filed: Jul. 21, 1981

[51] Int. Cl.[3] ..... H05B 7/08

[52] U.S. Cl. ..... 373/93

[58] Field of Search ..... 373/91, 92, 93

[56] References Cited

FOREIGN PATENT DOCUMENTS 2037549 7/1980 United Kingdom ..... 373/93

*Primary Examiner*—Roy N. Envall, Jr.

*Attorney, Agent, or Firm*—Woodrow W. Ban

[57] ABSTRACT

Electrode for arc furnaces, more particularly for electrosteel production, also using scrap, comprising a detachable top portion (5) of metal and a replaceable bottom portion (6) of material which is consumed, where appropriate only slowly, having substantially cylindrical shape and being interconnected by a screw nipple (1) or the like and the top portion has a liquid cooling device with a header duct (2) and a return duct (3) and an inner part (16) and an outer part (17) of the top portion are constructed so as to be detachable from each other, so that the inner part (16) contains the liquid conducting chamber with header duct and return duct and the outer part (17) surrounds only a portion of the inner part (16). The electrodes have a reliable coolant conducting system, are easy to maintain and can be simply repaired in the event of mechanical damage while minimizing electrode down times.

12 Claims, 4 Drawing Figures

ELECTRODE FOR ARC FURNACES

This invention relates to an electrode for arc furnaces comprising a detachable top portion of metal and a replaceable bottom portion of consumable or only slowly consumable material, substantially of cylindrical shape and connected to each other by means of a screw nipple or the like, the top portion having a liquid cooling means with a header duct and a return duct.

Such electrodes, for example as disclosed in the German Auslegeschrift No. 27 39 483, offer an advantage over conventional carbon electrodes, in that only the electrode tip is consumable and requires replacement. The remaining part of the electrode, namely the liquid cooled electrode holder, can be used for a longer period of time.

When used in an arc furnace, particularly an arc furnace in which scrap is melted, such electrodes are exposed to substantial stresses. Damage to the electrode, for example in the region coated with a material of high temperature stability, or in the liquid cooled top part of the electrode, can occur simply when the electrode moves into the furnace. Furthermore, there is the risk of arc breakthrough between the top metal shank, which conducts the both electrical current and the coolant liquid, and the metallic contents of the arc furnace. Sliding of scrap into the melt also provides mechanical stresses which combined with other factors can lead to electrode failure as well as to discharge of the coolant fluid into the arc furnace, and thereby to explosions.

Liquid cooled arc electrodes in which the electrode tip also consists of non-consumable material but is constructed from liquid cooled metal, are particularly exposed to these risks. Such electrodes have been disclosed, for example in German Offenlegungsschrift No. 15 65 208 and U.S. Pat. No. 3,689,740 wherein the arc is guided over the electrode tip by means of magnetic fields or adequate velocity. Owing to the risk of short circuit when the electrodes enter or due to the tendency to sustain damage when the charge is melted, it was not possible for such electrodes to be accepted for use in arc furnaces in which scrap is also melted.

British Patent Specification No. 1 223 162 therefore proposed the use of liquid cooled metal shanks with a consumable part, the metal shank is provided with a ceramic protective coating. Belgian Patent Specification No. 867 876 also describes such an electrode in which water conducting tubes are embedded in a compound of refractory material.

European Patent Application No. 79302809.3 also describes a ceramically protected electrode in which the liquid cooling system extends centrally in the metal shank. Graphite rods, the fracture or errosion of which can be monitored by the pressure of gas which flows around the rods, are inserted into such shanks. Although this construction of the metal shank facilitates monitoring of mechanical damage, the construction of the entire electrode is relatively complex and actually mechanical damage occurring to the metal shank can be remedied generally only with a substantial effort after removal of the entire electrode.

The German Auslegeschrift No. 27 39 483 also describes an electrode of the initially mentioned kind in which liquid cooling is ensured inter alia by annular ducts which are directly guided on the external wall. In this system, special attention has been given to ensure that the liquid return adjoins directly on the external surface line of the metal shank so that the external wall of the metal shank also represents the internal wall of the return duct. To facilitate maintenance and inspection it is finally possible to remove the entire inner part from the outer part of the top portion. To this end it is necessary to release the screw fasteners of a ring flange and to lift out the internal structure after shutting down the supply of liquid and emptying the cooling system. However, in the event of damage in the region of the top portion, this electrode does not permit any rapid and relatively simple means of repair. Furthermore, mechanical damage of the top portion or as a result of short circuits leads directly to water breakthrough as a result of the externally disposed annular ducts and return ducts and in some cases leads to explosions associated with such a defect.

It is the object of the invention to provide a reliably operating electrode which is easy to maintain and less trouble prone. It is to be particularly easy to instal or to dismantle for inspection. Escape of cooling fluid is to be avoided in the event of mechanical damage of the electrode and rapid simple repair is to be possible while minimizing the down times.

This problem is solved by an electrode of the initially mentioned kind in which an inner part and an outer part of the top portion are constructed so as to be detachable each from the other, the inner part including a liquid cooling means having header and return ducts, the outer part only partially surrounds the inner part.

The outer part performs as a terminal electrode and can consist of the same metal or metal alloy as comprises the inner part. Cooling ports or the like can be provided in the outer part. It is also possible to provide the outer part with retaining bores, for example for biasingly guiding and supporting insulating protective layers which are disposed below.

In a preferred embodiment of the electrode according to the invention the inner part is only partially surrounded by the outer part so that the metal shank in its entirety can be formed to include a top region of larger diameter and a bottom region of smaller diameter. The inner part of such an electrode can be protected by an insulating layer of high temperature stability, for example advantageously adjoining the outer part and extending downwardly to a point near the screw nipple or the like or beyond such screw nipple to a partial covering, usually small, of the consumable part. The insulating layer of high temperature stability can consist of a ceramic material but also can consist of graphite coated with a ceramic material. It is particularly advantageous if the insulating coating comprises a solid moulding, for example a coated individual graphite tube or a series of parts or segments which are self-supporting, in an abutment, for example in accordance with a tongue and groove system, and are movable in the direction of the electrode axis.

In the preferred embodiment of the electrode, in which a partial top region of the inner part, more particularly in the region of the lateral current supply means, is surrounded, it is not usually necessary to cover the outer part additionally with a ceramic, insulating coating. This will however depend on the dimensions of the height of the outer part in relation to the inner part and can be determined in accordance with the use and purpose of the electrode.

The inner part of the electrode extends to a nipple connection by means of which the top metallic portion and the consumable bottom portion are threadably interconnected. The liquid cooling device of the inner part, extending axially therein, is advantageously extended to the screw nipple, since this threadable interconnection can be exposed to particular heat stresses depending on the material used in forming such a screw nipple.

The connection between the inner and outer part can be effected in different ways. The connecting line usually extends parallel with a longitudinal electrode axis. For example, the detachable connection can be obtained by screwthreading or by appropriate fitting of the parts. It is particularly preferred for the inner part to be constructed as a register member of conical or taper form and for sections of the outer and of the inner parts, where appropriate, and to have additional screwthreading.

Connecting jaws can be attached to the outer part, for example by means of pocket or retaining means to which the current supply for the electrode is connected. Pockets, in which graphite plates or segments are introduced to supply current, are attached to the outer part in a preferred embodiment of the invention.

The inventive construction of the electrode achieves a series of advantages. By virtue of the water duct system being guided in the inner part, this system remains intact even if the outer part is mechanically damaged. In the event of damage of the outer region of the top portion it is therefore not necessary to interrupt the supply of cooling liquid, to empty the electrode etc. The simple detachability of the outer portion enables this to be readily exchanged as a component in the event of damage while more conventional constructions call for complete repair of the metal shank or its replacement. The lateral current supply, for example via graphite contact jaws or segments, which are attached, for example in retaining pockets formed in the outer part, dispenses with the need for removal of the electrode in its entirety on the busbar in the event of defects in the region of the internally disposed liquid duct system, since the internal part alone may be detached. By constructing the top region as two parts, one of larger diameter and one of smaller diameter it is possible for the insulating protective layer of high temperature stability to be connected in a particularly compact and convenient form and it is not necessary in addition to protect the outer part in insulating manner, if this is confined to the current supply means.

The invention will be explained in the drawings in which identical reference numerals are employed for identical parts. Although the drawings refer to preferred embodiments of the electrode according to the invention it is not confined thereto. In the drawing.

Figure 1:
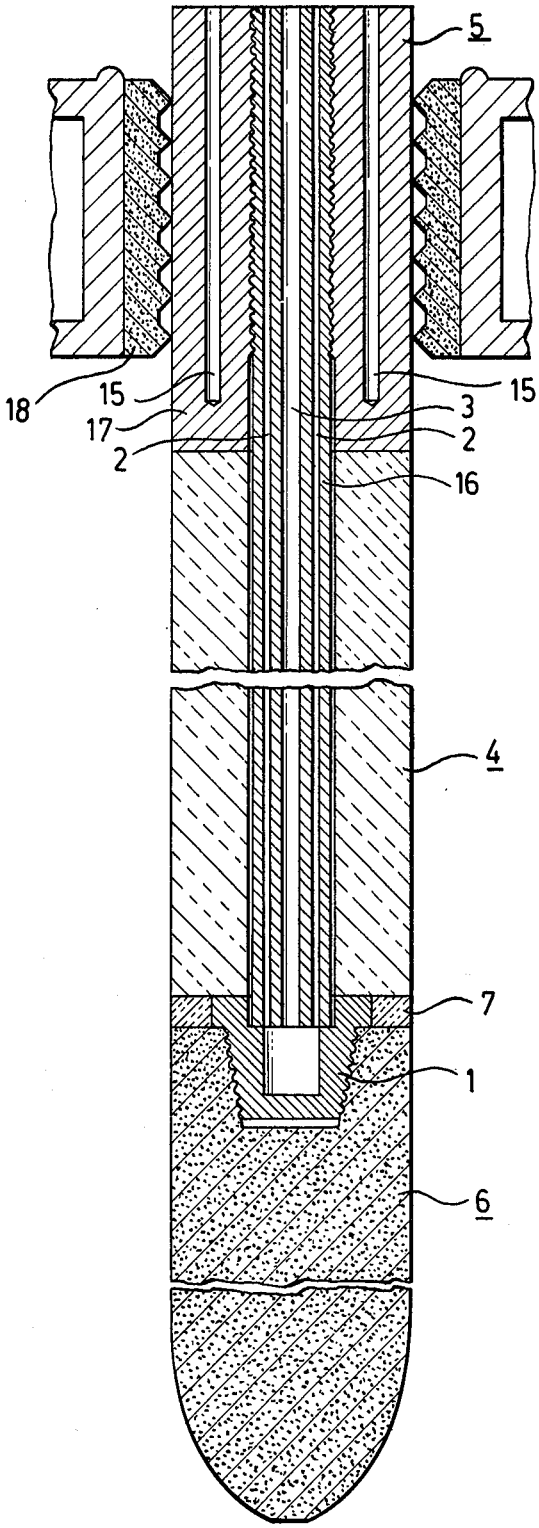
FIG. 1 is a longitudinal section through an electrode according to the invention.

FIG. 1 shows the basic construction of the electrode comprising the top portion 5 and the bottom portion 6, which are interconnected by a screw nipple 1. Fluid is supplied through a central header duct 2 and the coolant liquid is again discharged via the return ducts 3. The illustrations clearly show that the cooling system is guided in the internal part 16 which the outer part 17 surrounds.

Figure 2:
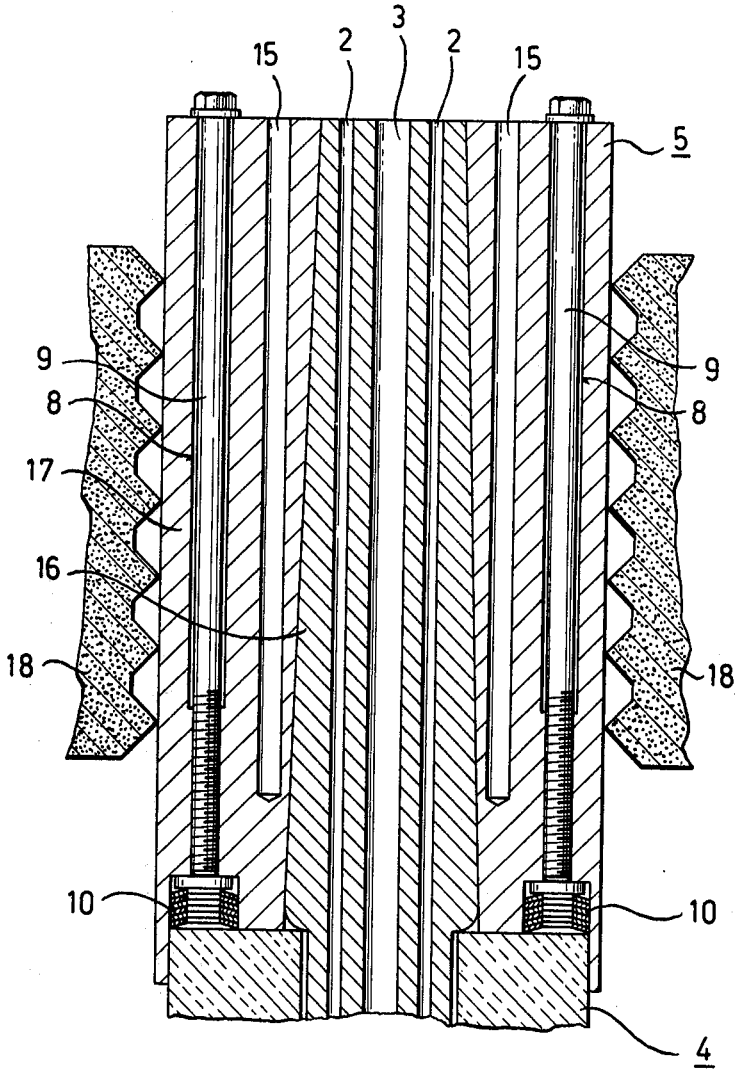
FIG. 2 is a longitudinal section through the top part of an electrode with an alternative top portion and the electrode is sectioned in the region of the insulation.
Figure 3:
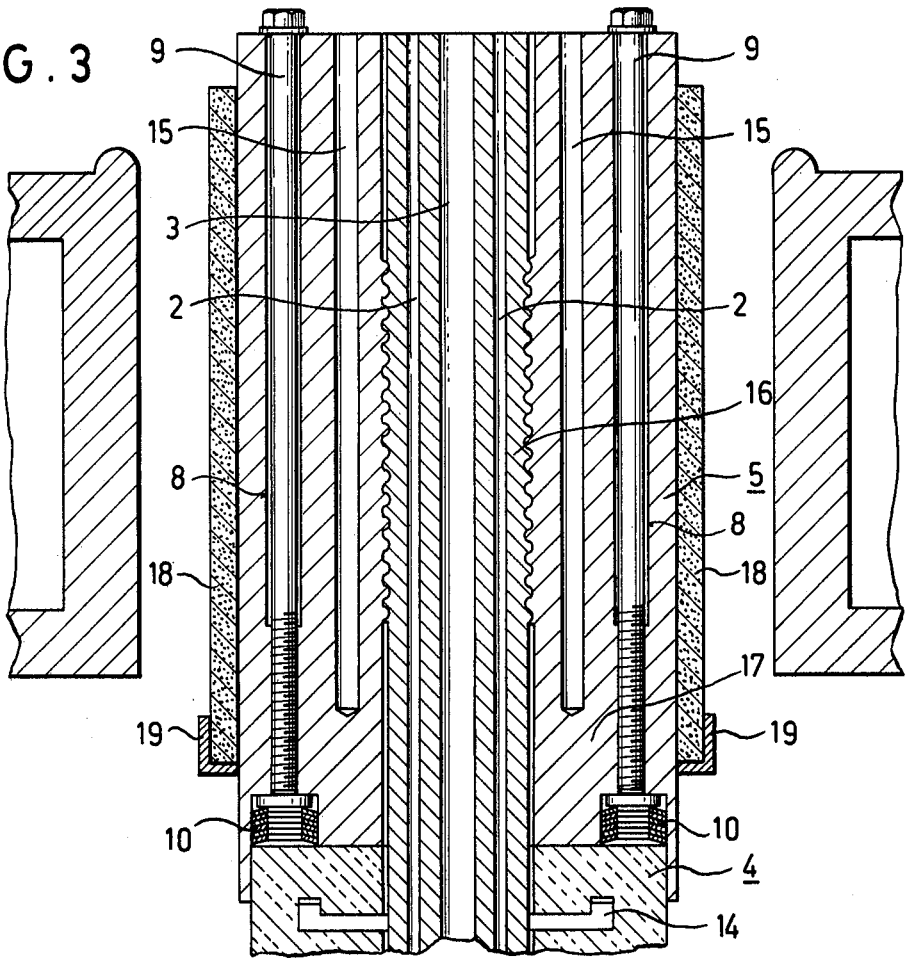
FIG. 3 is a longitudinal section through the top part of an electrode with an alternative top portion, and the electrode is sectioned in the region of the insulation
Figure 4:
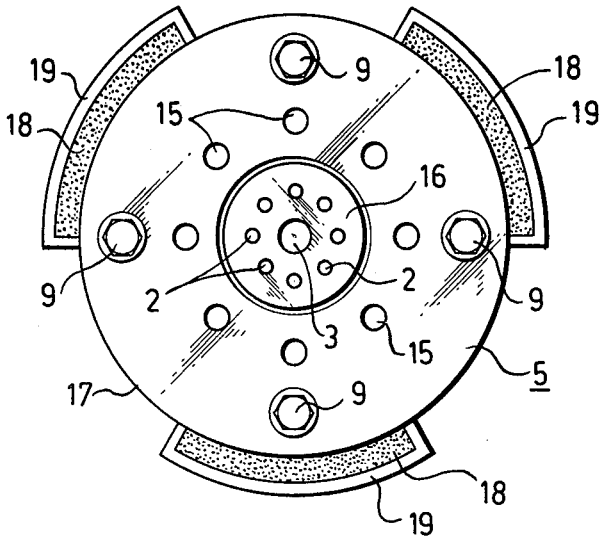
FIG. 4 is a cross-section through the top portion of the electrode.

Some of the preferred means of connecting the inner part 16 and the outer or upper part 17 as a register member, where appropriate with additional part screwthreading, can be seen particularly by reference to FIGS. 2 and 3. Pins 9 or the like can be guided by means of bores 8 to retain an insulating coating 4 via the spring 10 on an abutment 7. The insulating part can be additionally secured by retaining means 14. Cooling ports 15 are shown in the outer part while connecting jaws 18, for example of graphite, are shown on the outside. These jaws can be secured in retaining means or pockets 19 which are attached to the outer edge of the metal shank.

We claim:

1. An electrode for arc furnaces, having s top, metallic portion and a consumable, replaceable bottom portion, the portions being substantially cylindrical and including a threadable interconnection therebetween, said top portion including a liquid cooling means having header and and return ducts, the improvement comprising: the top portion being formed from an inner part and a single outer part including a detachable connection therebetween, said inner part containing a liquid conducting chamber including said header and return ducts, and wherein said outer part radially surrounds only a longitudinal portion of said inner part.

2. An electrode as claimed in claim 1, wherein said outer part performs as a terminal electrode.

3. An electrode as claimed in claim 1, wherein said outer part is provided with cooling ports and bores for receiving a retaining means.

4. An electrode as claimed in claim 1, wherein only upper portions of the inner part are surrounded by the outer part.

5. An electrode as claimed in claim 4, wherein portions of the inner part not surrounded by the outer part are protected by an insulating layer of high temperature stability.

6. An electrode as claimed in one of claims 1–5, wherein the inner part threadably interconnected with a screw nipple whereby the top and bottom portions of the electrode are interconnected.

7. An electrode as claimed in claim 1, wherein the detachable connection of the inner part and the outer part is situated along an axis of the electrode.

8. An electrode as claimed in claim 7, wherein said detachable connection is a screw threading connection.

9. An electrode as claimed in claim 7, wherein the inner and outer parts include tapered surfaces conforming one to the next, and wherein the detachable connection is formed by a register fit between the tapered surfaces and wherein the tapered surfaces of said inner and outer parts include screw threading for interconnecting the tapered surfaces.

10. An electrode as claimed in claim 1, graphite jaws being attached to the outer part.

11. An electrode as claimed in claim 6, wherein the liquid cooling means of the inner part includes means for introducing coolant into the screw nipple.

12. An electrode as claimed in claim 7, wherein the inner and outer parts include tapered surfaces conforming one to the next, and wherein the detachable connection is formed by a register fit between the tapered surfaces.

* * * * *

UNITED STATES PATENT AND TRADEMARK OFFICE

CERTIFICATE OF CORRECTION

PATENT NO. : 4,425,657

DATED : January 10, 1984

INVENTOR(S) : Bauer et al

It is certified that error appears in the above-identified patent and that said Letters Patent are hereby corrected as shown below:

Column 4, line 18, delete "s" and insert --a--.

Column 4, line 23, delete "and" after the word "and".

In the ABSTRACT, delete the following:

"Electrode for arc furnaces, more particularly for electrosteel production, also using scrap, comprising a detachable top portion (5) of metal and a replaceable bottom portion (6) of material which is consumed, where appropriate only slowly, having substantially cylindrical shape and being interconnected by a screw nipple (1) or the like and the top portion has a liquid cooling device with a header duct (2) and a return duct (3) and an inner part (16) and an outer part (17) of the top portion are constructed so as to be detachable from each other, so that the inner part (16) contains the liquid conducting chamber with header duct and return duct and the outer part (17) surrounds only a portion of the inner part (16). The electrodes have a reliable coolant conducting system, are easy to maintain and can be simply repaired in the event of mechanical damage while minimizing electrode down times." and Insert

UNITED STATES PATENT AND TRADEMARK OFFICE

CERTIFICATE OF CORRECTION

PATENT NO. : 4,425,657

DATED : January 10, 1984

INVENTOR(S) : Bauer et al

It is certified that error appears in the above-identified patent and that said Letters Patent are hereby corrected as shown below:

--An electrode for particularly electrosteel arc furnaces, including a detachable metallic top portion and a consumable, replaceable bottom portion both portions having a substantially cylindrical shape and being threadably interconnected, the top portion having a liquid cooling device including header and a return ducting, the top portion is formed from inner and outer parts constructed so as to be detachable one from the other, with the inner part containing the header and return ducts and the outer part surrounding only a portion of the inner part.--.

Signed and Sealed this

*Twenty-second* Day of *May 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,425,657

DATED : January 10, 1984

INVENTOR(S) : Bauer et al

It is certified that error appears in the above-identified patent and that said Letters Patent are hereby corrected as shown below:

In the Cover Page:

Left hand column, after "[22] Filed: Jul. 21, 1981 there should be inserted
--Foreign Application Priority Data
Oct. 27, 1980 [EP] European Pat. Off. 80106582--.

Signed and Sealed this

*Eighteenth* Day of *December 1984*

[SEAL]

*Attest:*

*Attesting Officer*

GERALD J. MOSSINGHOFF

*Commissioner of Patents and Trademarks*